US005704662A

United States Patent [19]

Kwiatkowski

[11] Patent Number: 5,704,662

[45] Date of Patent: Jan. 6, 1998

[54] DOOR LATCH AND LADDER STABILIZING APPARATUS

[76] Inventor: Frank P. Kwiatkowski, 311 N. Drake Ave., Fullerton, Calif. 92632

[21] Appl. No.: 555,313

[22] Filed: Nov. 8, 1995

[51] Int. Cl.[6] ..... E05C 19/18

[52] U.S. Cl. ..... 292/194; 292/259 R; 292/202

[58] Field of Search ..... 292/194, 202, 292/114, DIG. 38, 259 R, 288, 105, 106

[56] References Cited

U.S. PATENT DOCUMENTS

| | | | |
|---|---|---|---|
| 637,160 | 11/1899 | Richter | 292/105 X |
| 2,336,129 | 12/1943 | Sargisson et al. | 292/106 |
| 2,702,866 | 2/1955 | Anderson | 292/114 X |
| 2,731,238 | 1/1956 | French et al. | 292/114 X |
| 2,896,989 | 7/1959 | Ehret | 292/114 |
| 3,335,453 | 8/1967 | Lovelace | 292/175 X |
| 4,009,754 | 3/1977 | Hoebing | 292/DIG. 65 X |
| 4,189,176 | 2/1980 | Hamilton | 292/288 X |
| 4,232,890 | 11/1980 | Hoen | 292/114 |
| 4,290,633 | 9/1981 | Sullivan | 292/DIG. 38 X |

*Primary Examiner*—Rodney M. Lindsey
*Assistant Examiner*—Monica E. Millner
*Attorney, Agent, or Firm*—Edward E. Roberts

[57] ABSTRACT

A security latch for doors and the like is disclosed including a link member one end of which is pivotably secured to the inside of the door and the other end is swingable to a position overlapping the door frame. One side of the swingable end is notched for engagement with a stop fixedly mounted to the door frame for lockable engagement with the notched portion of the link member. A locking knob is threadably mateable with the stop and after the link member is engaged with the stop, the locking knob is tightened to removably clamp the link member in locking engagement with the stop and the locking knob.

11 Claims, 4 Drawing Sheets

DOOR LATCH AND LADDER STABILIZING APPARATUS

BACKGROUND OF THE INVENTION:

1. Field of the Invention

This invention relates primarily to security latches for doors and the like, and, more particularly, to mechanical door latches for sliding doors and windows. A second embodiment relates to apparatus for stabilizing step ladders.

2. Description of the Prior Art

The prior act is replete with various and diverse types of door securing devices. Some of these door securing devices such as typically found in the prior art include locks, slide bolts, slide chains, and similar devices. While slide bolts provide some measure of security, they are ineffective in any public use areas such as motels and hotels where the innkeepers must have a master key for all the rooms.

Since the mere existence of a master key creates the possibility of a copy falling into the hands of unauthorized personnel, and, as a result, another lock is necessary to secure the door from the inside of the room in order to give the occupants a measure of security while occupying the room, hence, the creation and use of inside, non-key operable, door locks.

Chain locks are sometimes employed to provide such a non-key door latch. However, it has been found, as a practical matter, that chain locks provide more of a psychological rather than an actual physical deterrent. If an authorized individual has a master key or access to the use of such a master key, they will find that a chain lock presents no barrier since, even if it cannot be worked from the exterior with the door partially opened (which such chain locks permit), the chain can be easily and quietly cut.

Slide bolts, on the other hand, provide an improvement over chain locks. However, slide bolts as presently employed fail to provide a significant measure of protection, because they are not properly anchored to the door or the door frame and/or because they will become misaligned and become difficult to use or lock. Additionally, there is some question as to whether or not sliding bolts should be used in public facilities because such may be difficult to operate, thereby providing a hazard in the event of a fire, and because such establishments must allow for the possibility of emergency entry into the locked room from the outside without major damage.

With the aforementioned restrictions of the established prior art devices, others have been encouraged to develop and use other forms of hinged or swinging latch devices having a portion affixed to the door frame and a swing or slide portion extendable into an overlapping relationship with the door. However, such devices have generally required engagement with a door-carried member thereby relying in part upon the strength of the anchor to the door while further having the same misalignment problems as experienced and discussed with previously discussed and described devices.

For all of these reasons, it would therefore be an advance in the art to provide an improved security latch which is not dependent upon the strength of any mounting portion attached to the door, which is easily and quickly actuable, and which does not require overly precise alignment of co-fitting parts.

The prior act is likewise replete with various and diverse types of step ladder stabilizing devices, however for the most part such devices are inadequade for the use intended and quite often dangerous in use.

SUMMARY OF THE INVENTION AND OBJECTS

Fundamentally, the present invention disclosed herein is a security latch for doors, and the like, particularly suitable for use on the inside facing portion of the door, including a link member one end of which is pivotably secured to the inside of the door and the opposite end is swingably movable to a position overlapping the door frame. One side of the swingable end is notched for engagement with a stop fixedly mounted to the door frame for lockable engagement with the notched portion of the link member. A locking knob is threadably mateable with the stop, and after the link member is engaged with the stop, the locking knob is tightened to removably clamp the link member in locking engagement with the stop and the locking knob.

An alternate embodiment discloses use of the basic design of the invention in apparatus for stabilizing step ladders.

It is, therefore, an object of this invention to provide an improved door security latch.

It is another primary and important object of the present invention to provide a door security latch which utilizes a pivotable member attached to the door including a link swingably extendable to a position overlapping the door frame, the link having a notched portion of the bottom side thereof, and a stop securely fixed to the door frame, the stop having a knob threadably secured thereto, whereby when the notched portion of the link is operably coupled to the stop, the knob may be tightened and the link securely clamped to the stop, and, in turn, to the door frame.

Another important object of the invention is to provide a visual means for indicating whether or not the latch is locked or unlocked to insure that it is in the condition desired by the occupant of the room.

An additional object of the invention is to provide apparatus for stabilizing step ladders.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure herein.

DESCRIPTION OF THE PREFERRED EMBODIMENT OF THE INVENTION

Figure 1:
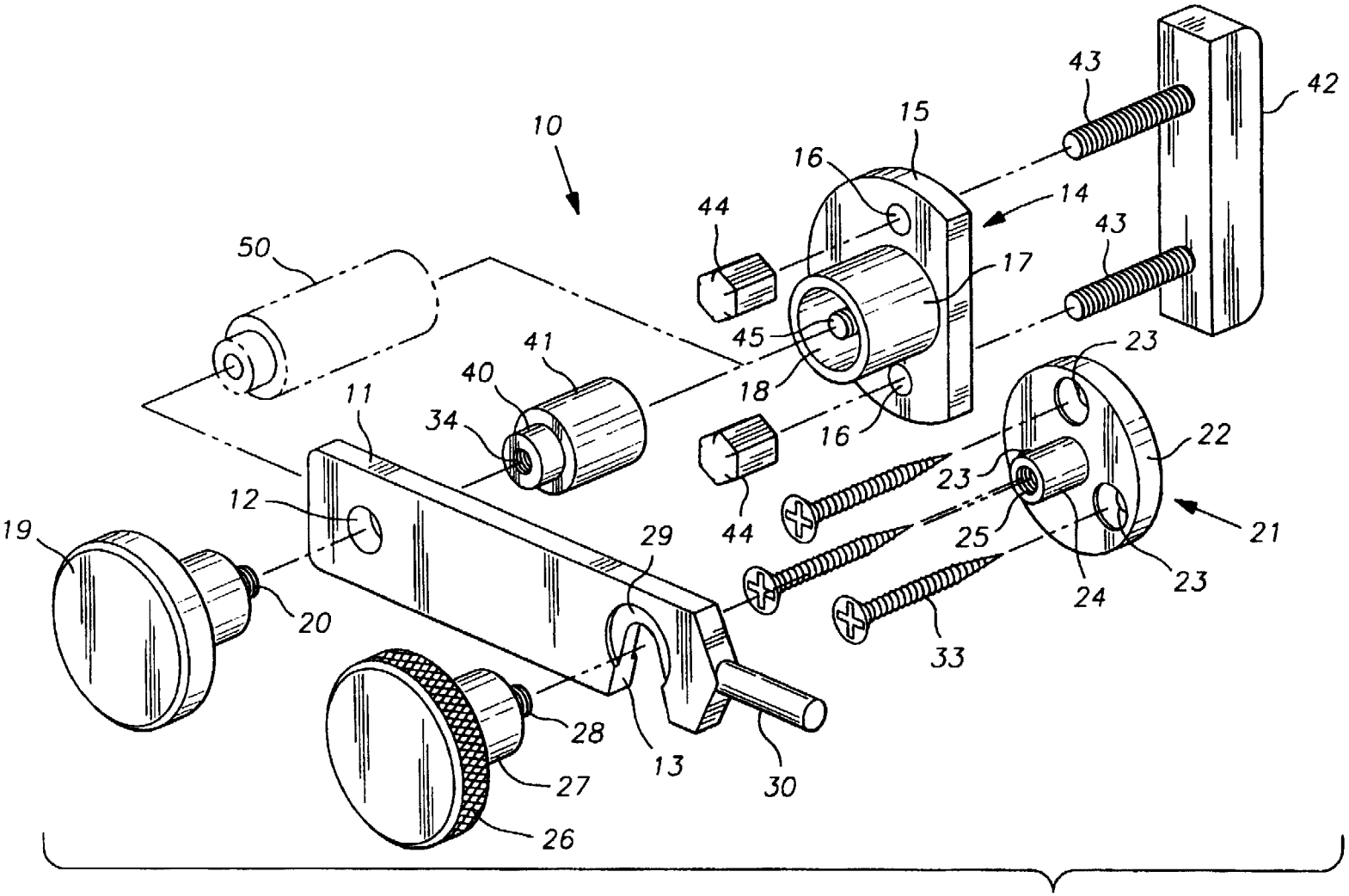
FIG. 1 is an exploded assembly view of the instant invention shown in perspective form.
Figure 2:
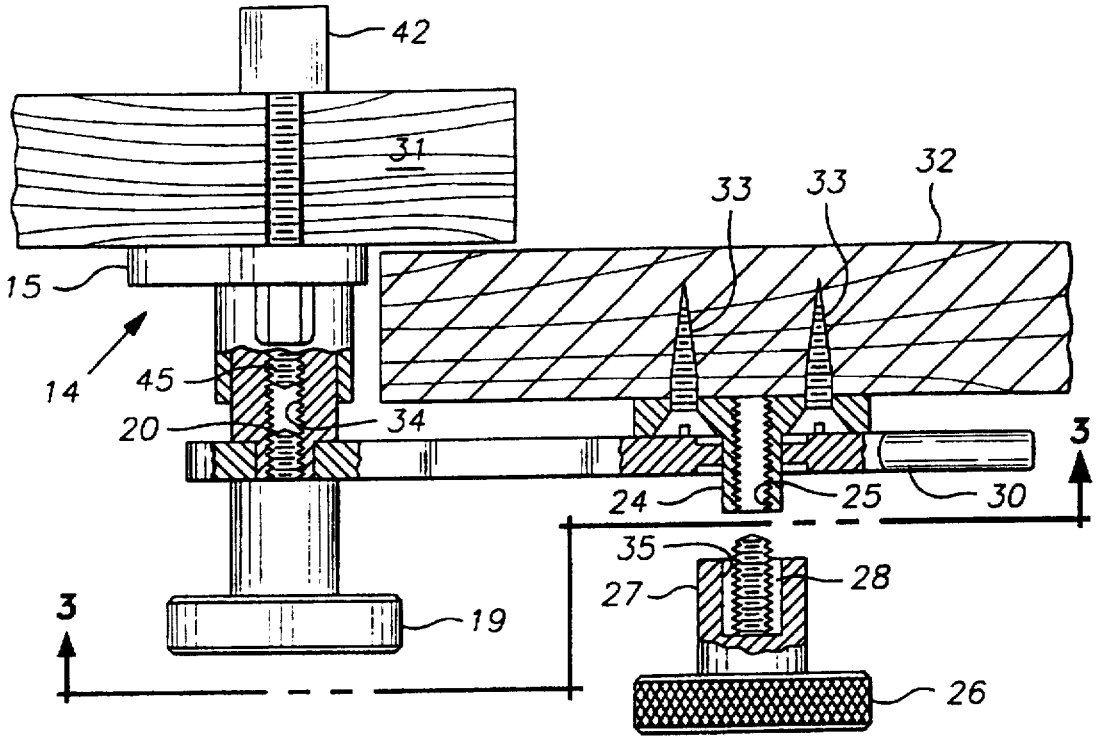
FIG. 2 is a top view of the present invention, shown partially in section, mounted to a door and a door frame.
Figure 3:
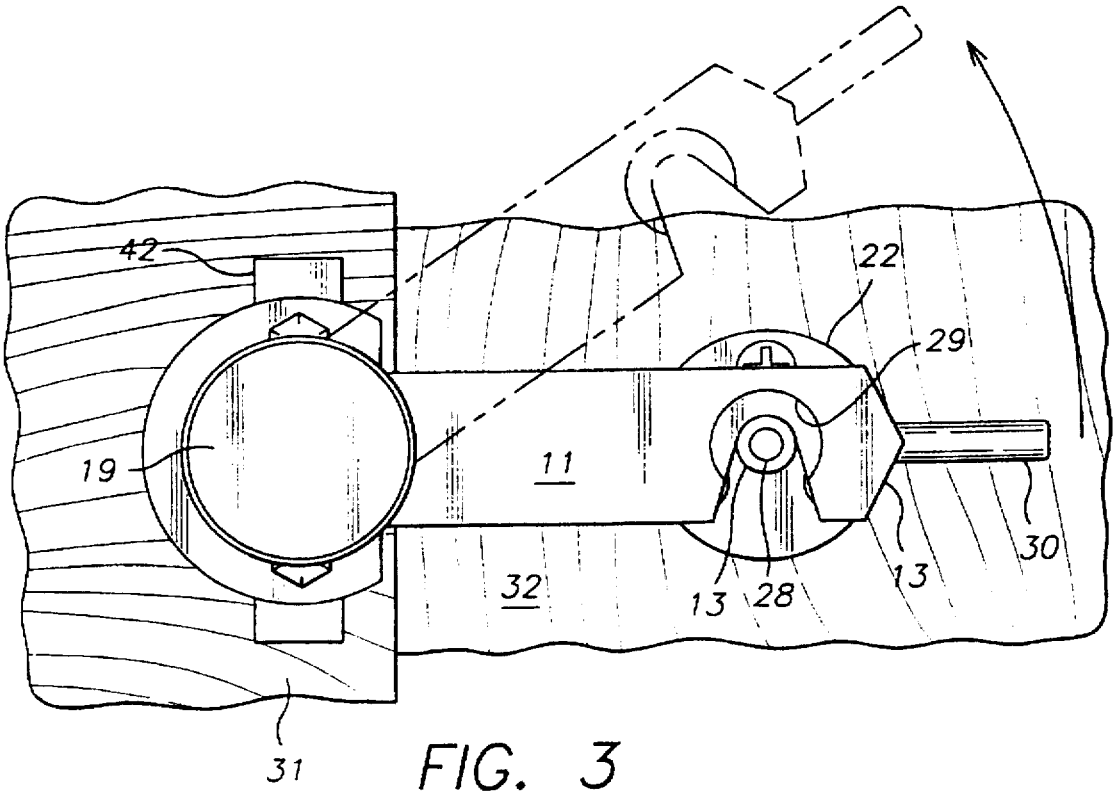
FIG. 3 is a view of the invention taken along Plane 3—3 of FIG. 2.

With continued reference to FIGS. 1–3 of the drawings herein, there is generally indicated at 10, an improved security latch for doors and the like.

The security latch comprises a link member 11, having an aperture 12 in one end thereof and a notch 13 in the other end thereof with an undercut portion 29 thereon, a first mounting base, generally indicated at 14, including a flange 15 having a plurality of mounting holes 16 therein. Mounting base 14 is secured to doorframe 31 by fasteners such as threaded means 43 and cap nuts 44, threaded means 43 passing from mounting bar 42 through the mounting holes 16 in the flange 15.

Flange 15 has a centrally-disposed diametered axle body member 17 having a receptacle 18 for receiving a dual diametered axle body member 41, receptacle 18 having a centrally disposed threaded rod 45 therein adapted to be threadably mateable to dual diametered axle body member 41 as will be hereinafter described.

Axle body member 41 has a smaller diametered portion 40 which has a threaded receptacle 34 extending therethrough, the smaller diametered portion 40 being adapted to be mateable with the aperture 12 in the link member 11.

First knob 19 has triple diametered portions, the largest diametered portion forming a surface for manually gripping and turning the knob 19, a second diametered portion substantially equal in diameter to the smaller diametered portion 40 of axle body member 41, and a third, and smallest, diametered portion adapted to form a threaded rod 20 which is adapted to be threadably engaged with the receptacle 34. The opposite end of receptacle 34 is adapted to threadably receive threaded rod 45.

If needed for specialized installation, axle body member 41 can be elongated as shown in phantom by member 50.

Second mounting base, generally indicated at 21, includes flange 22 having a plurality of mounting holes 23 therein and a centrally-disposed cylindrical body portion 24 having a threaded receptacle 25 therein.

Second knob 26 has dual diametered portions, the larger diametered portion forming a surface for manually gripping and turning the knob, the smaller diametered portion 27 having a counter-bored portion 35 therein (see FIG. 2) and a centrally disposed body with a threaded rod 28 therein adapted to be threadably mateable with the threaded receptacle 25 in the body portion 24 of the second mounting base 21.

At the end of the link member 11 opposite from the end having an aperture 12 therein wherein a notch 13 is located, the innermost portion of the notch 13 is conformably mateable about the body portion 24 and has an undercut portion 29 thereabout, the undercut portion 29 being complementary mateable with the centrally-disposed body portion 27.

A small handle 30 is secured to the notch end of the link member 11, the purpose and use of which will become clearer as the description of the instant invention proceeds further herein.

Mounting of the Door Latch

The door security latch of the invention is shown in its mounted configuration in FIG. 2. The first mounting base 14 is secured by fasteners as herein before described. The link member 11 is pivotably secured to the door frame 31 via the knob 19 having a threaded rod 20 which is passed through the aperture 12 and thereafter threadably mateable to the threaded receptacle 34 in the axle body member 41. Axle body member 41 is fitted into aperture 18 and threadably secured to flange 15 by engaging threaded member 45.

The aperture 12 in the link member 11 is conformably contoured to pivot about the smaller diametered portion 40 of the axle body member 41. The length of the rod 20 is so configured with respect to the receptacle 34 that it can be mated to prevent pivotable movement of the link member 11 by moving the face of the end of the smaller diametered portion 40 of the axle body member 41 into intimate abutment with the body of the link member 11 surrounding the aperture 12.

In its unlocked or disengaged position, the link member 11 simply hangs downwardly thereby providing a visual signal to the occupant that the door latch 10 is unsecured or unlocked, and, therefore, not in use.

The door-mounted or movable portion of the improved security latch 10 is mounted to the door 32 via fasteners 33, such as screws, passed through the mounting holes 23 in the second mounting base 21, which is so positioned on the door 32 that when the link member 11 is swung to overlap onto the closed door 32, the notch 13 is mated with the body portion 24. It should be noted that the notch 13 is configured in an inverted V shape so that in the event of slight mounting inaccuracies which may result in slight alignment inaccuracies, the notch 13 because of its shape, will allow for such inaccuracies and still permit mating of the notch 13 with the body portion 24.

The handle 30 provides a convenient means for manually moving the link member 11 into and out of engagement with the body portion 24.

Operation of the Door Latch

In operation of the door security latch, the sliding door 32 is moved into intimate contact with the stationary door frame 31. Thereafterwards, the link member 11 is manually swung by the handle 30 into engagement with the body portion 24 of the second mounting base 21 secured to the door 32, via the notch 13. Once this is accomplished, the knob 26 is tightened into clamping engagement with the undercut portion 29 of the link member 11, thereby effectively locking the improved security latch 10.

DESCRIPTION OF THE ALTERNATE EMBODIMENT OF THE INVENTION

Figure 4:
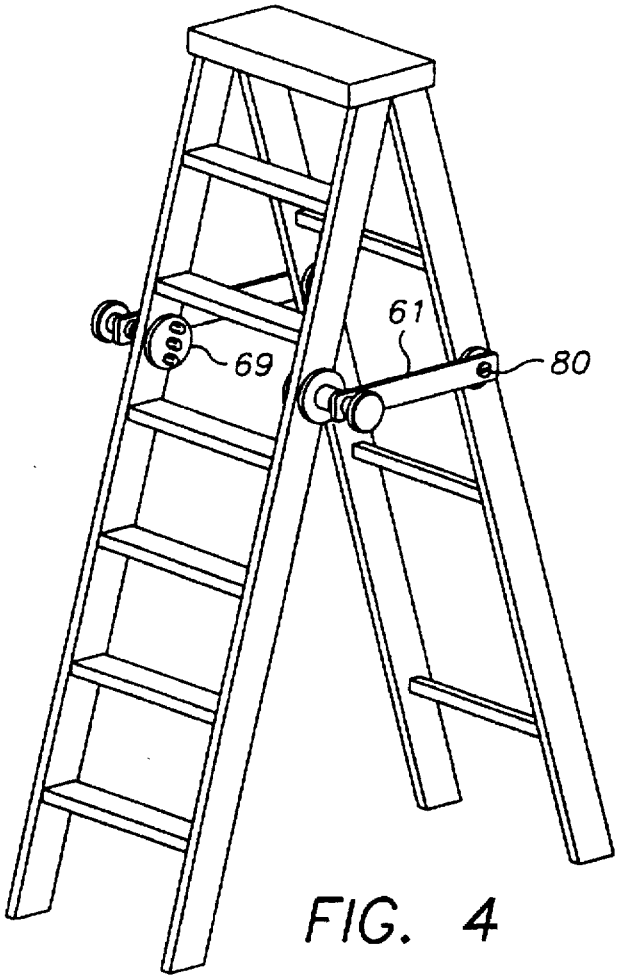
FIG. 4 is a view of the ladder stabilizing embodiment of the invention showing stabilization lock of a conventional step ladder.
Figure 5:
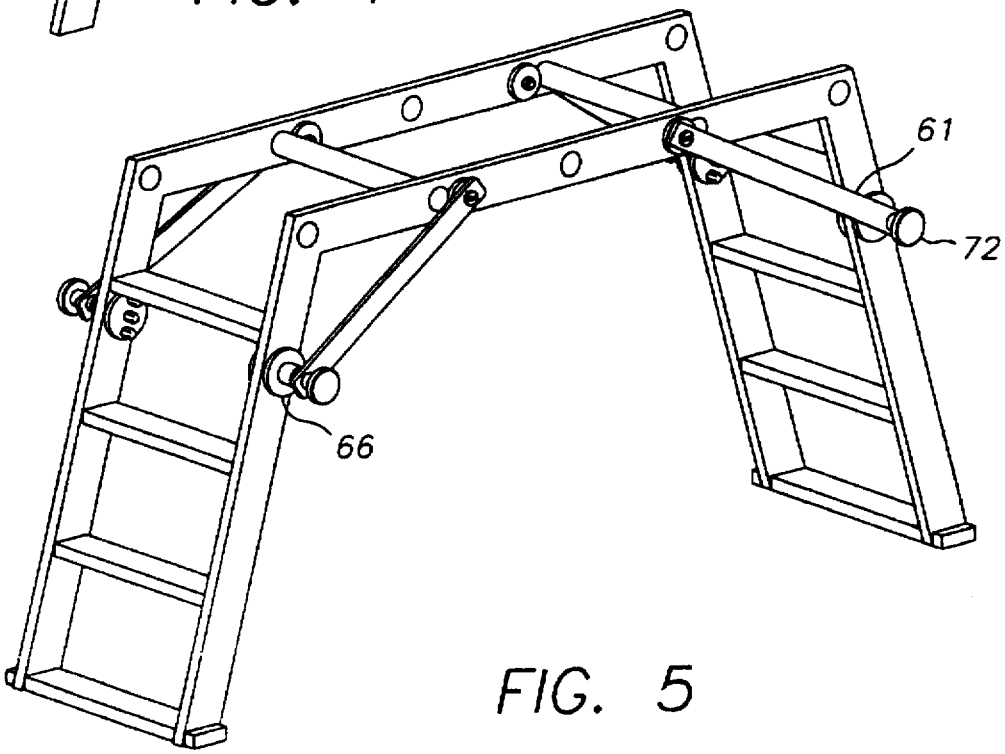
FIG. 5 is a view of the ladder stabilizing embodiment of the invention showing stabilization lock of another step ladder configuration.
Figure 6:
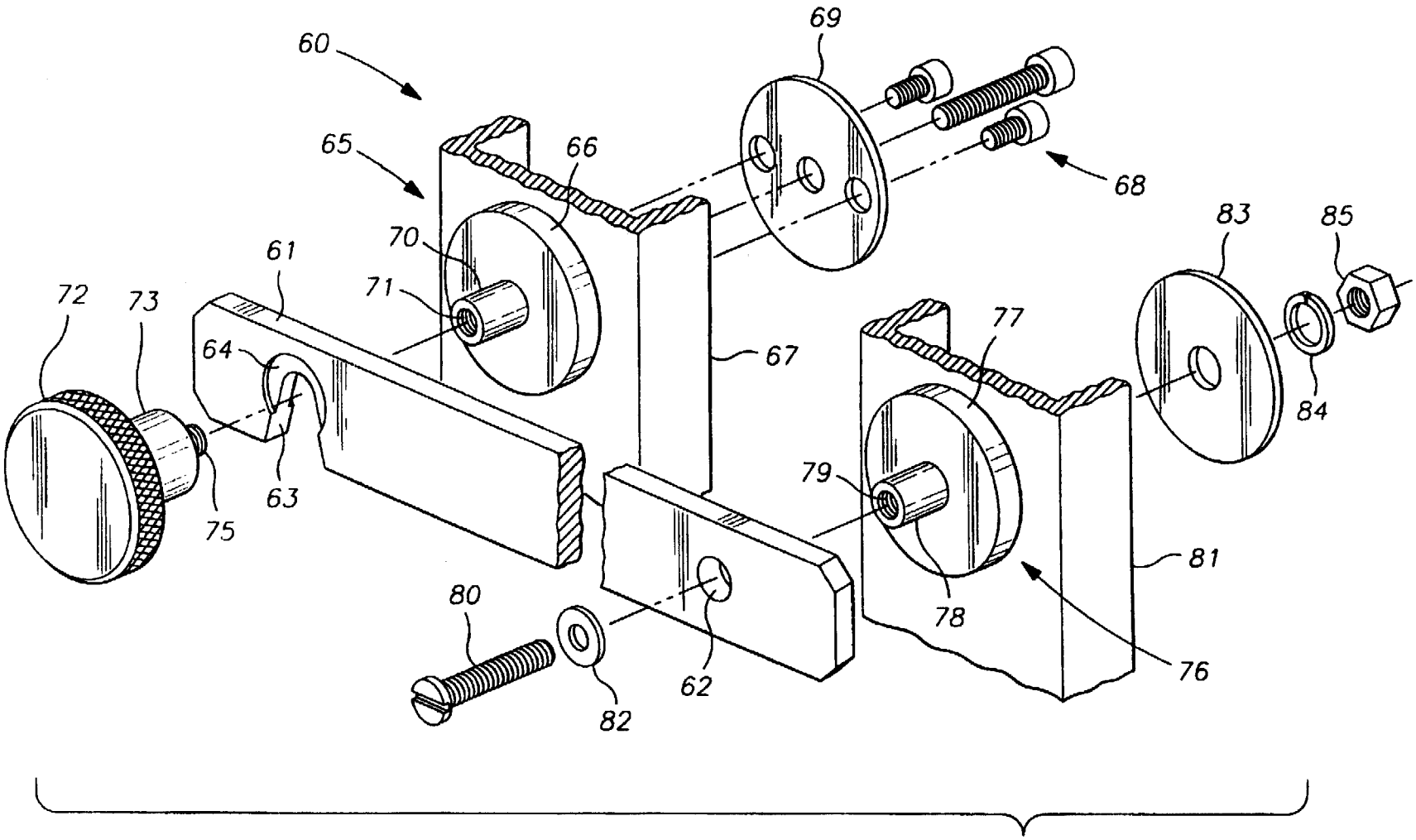
FIG. 6 is an exploded assembly view of the step ladder embodiment of the instant invention shown in perspective form.

With reference to FIGS. 4–6 of the drawings herein, there is generally indicated at 60, apparatus for stabilizing step ladders in accordance with the invention.

The ladder stabilizer comprises a link member 61, having an aperture 62 in one end thereof and a notch 63 in the other end thereof with an undercut portion 64 thereon, a first mounting base, generally indicated at 65, having a flange 66 with a plurality of threaded mounting holes therein (not shown). Mounting base 65 is secured to ladder leg 67 by threaded fasteners 68 passing through retainer plate 69 and threaded into the threaded mounting holes in flange 68.

Flange 66 has a centrally-disposed diametered axle body member 70 having a threaded receptacle 71 therein being adapted to be mateable with the notch 63 in the link member 61.

Knob 72 has triple diametered portions, the largest diametered portion forming a surface for manually gripping and turning the knob 72, a second diametered portion 73 substantially equal in diameter to the centrally disposed diametered portion 70, and a third, and smallest diametered portion 74 having a threaded portion thereabout to form a threaded rod 75 mounted thereto adapted to be threadably engaged with the receptacle 71.

Second mounting base, generally indicated at 76, includes flange 77 having a centrally disposed diametered portion having a threaded receptacle 79 therethrough being adapted to be mateable with threaded fastener 80. Second mounting base 76 is secured to ladder leg 81 by threaded fastener 80 passing through washer 82 and aperture 62, threaded through threaded receptacle 79, and passing through retainer plate 83 and lock washer 84 to be secured by nut 85.

The apparatus for stabilizing step ladders is mounted and operated in much the same manner as described for the security latch described hereinabove.

Although the present invention disclosed herein has been described with reference to a preferred and alternate embodiment of my invention, it is to be clearly understood that these particular embodiments are for illustration only and that other specific designs will be readily apparent to those skilled in the art which will fall within the spirit and scope of the invention which is intended to be limited only by the scope of the claims appended hereto.

What is claimed is:

1. An improved security latch for doors, comprising:

(a) a first mounting base including a flange with a plurality of apertures therein providing means for securing said flange to a stationary door frame, said first mounting base further including dual diametered axle body member threadably mated to said first mounting base with a smaller diametered portion about a free end of said axle body member, said first mounting base having a threaded receptacle therein;

(b) a second mounting base including a flange with a plurality of apertures therein providing means for securing said flange to a movable door, and a cylindrical body member thereon extending centrally therefrom, said cylindrical body member having a threaded receptacle therein;

(c) a link member having an aperture in a first end thereof adapted to be pivotally secured to said first mounting base about said smaller diametered portion of said axle body member, said link member further having a notched portion adjacent to a second end of said link member opposite said apertured first end with said notched portion being on an underside edge of said link member with said notched portion further having an undercut portion about said notched portion;

(d) a first knob having three diametered portions, a first diametered portion forming a surface for manually gripping and turning the knob, a second diametered portion substantially equal in diameter to said smaller diametered portion of said axle body member, and a third diametered portion thereabout adapted to be threadably mated to said threaded receptacle in said smaller diametered portion of said axle body member of said first mounting base to operably captivate said link member thereto, said second diametered portion being engageable and disengageable with a portion of said link member surrounding said aperture to alternatively prevent and allow movement of the link member with respect thereto;

(e) a second knob having dual diametered portions, a larger diametered portion thereof forming a surface for manually gripping and turning the knob, and a smaller diametered portion thereof having a bored out portion therein with a threaded rod centrally-disposed therein, said threaded rod being adapted to be threadably mated to said threaded receptacle of said cylindrical body of said second mounting base, whereby when the notched portion of the link member is positioned over the cylindrical body of said second mounting base and the second knob is tightened so as to bring a face of the smaller diametered portion of said second knob into intimate abutment with an area of the link member disposed between the notched portion and the bored out portion of said smaller diameter portion where a locking engagement is provided therebetween.

2. The security latch of claim 1, wherein said notch is V-shaped to accommodate misalignment between the notch and the second mounting base.

3. The security latch of claim 2 wherein said link member is shaped into the form of a blade.

4. The security latch of claim 1 wherein said means for securing said flanges of said first and second mounting bases are screws.

5. The security latch of claim 1 further comprising means for providing a visual indication of the unlocked condition of said latch wherein said notch of said link member is disengaged with said security latch hanging downwardly.

6. The security latch of claim 1 wherein said link member further includes a handle mounted to the second end of said link member adjacent to said notched portion of said link member.

7. A security latch for doors, comprising:

a first mounting base having a threaded receptacle therein;

a dual diametered axle body member having a first larger diametered end threadably mateable with said threaded receptacle of said first mounting base and a second smaller diametered end having a threaded receptacle therein;

a link member having an aperture in a first end thereof adapted to be pivotally secured about said smaller diametered portion of said dual diametered portion of said axle body member, said link member further having a notched portion on an underside thereof adjacent to a second end of said link member opposite said apertured first end;

a first knob having a first diametered portion for manually gripping and turning the knob and a second diametered portion adapted to be threadably mated through said link member aperture to said threaded receptacle in said smaller diametered portion of said axle body member of said first mounting base to operably captivate said link member thereto, said second diametered portion of said first knob being engageable and disengageable with a portion of said link member surrounding said aperture to alternatively prevent and allow movement of the link member with respect thereto;

a second mounting base with a cylindrical body member having a threaded receptacle therein extending from said second mounting base;

a second knob having dual diametered portions, a larger diametered portion thereof formed for manually gripping and turning the second knob, and a smaller diametered portion thereof having a bored out portion therein for receiving a portion of said cylindrical body member of said second mounting base and a threaded rod centrally-disposed in said bored out portion for threadably mating to said threaded receptacle of said cylindrical body of said second mounting base, whereby when the notched portion of the link member is positioned over the cylindrical body of said second mounting base and the second knob is tightened into intimate abutment with an area of the link member disposed between the notched portion and the bored out portion a locking engagement is provided therebetween; and said notched portion of said link further having an undercut portion about an innermost portion of said notched portion, said undercut portion being complementary mateable with said smaller diametered portion of said second knob.

8. The security latch of claim 7, wherein said notch is V-shaped to accommodate misalignment between the notch and the second mounting base.

9. An improved security latch, comprising:

first and second mounting bases each having a cylindrical body member extending therefrom, said cylindrical body member having a threaded receptacle therein;

a link member having an aperture in a first end thereof adapted to be pivotally secured about said cylindrical body member of said second mounting base, said link member further having a notched portion on an underside thereof adjacent to a second end of said link member opposite said apertured first end;

a knob having dual diametered portions, a larger diametered portion thereof forming a surface for manually gripping and turning the knob, and a smaller diametered portion thereof having a threaded rod disposed therefrom, said threaded rod being adapted to be threadably mated to said threaded receptacle of said cylindrical body of said first mounting base, whereby when the notched portion of the link member is positioned over the cylindrical body of said first mounting base and said knob is tightened into intimate abutment with said link member a locking engagement is provided; and a threaded fastener adapted to be threadably mated through said link member aperture to said threaded receptacle in said second mounting base to operably captivate said link member thereto.

10. The security latch of claim 9, wherein said notched V-shaped to accommodate misalignment between the notch and the second mounting base.

11. The security latch of claim 9, wherein said notched portion of said link further having an undercut portion about an innermost portion of said notched portion, said undercut portion being complementary mateable with said smaller diametered portion of said first knob.

* * * * *